US010544704B2

(12) United States Patent
Groleau et al.

(10) Patent No.: US 10,544,704 B2
(45) Date of Patent: Jan. 28, 2020

(54) TURBINE RING ASSEMBLY COMPRISING A PLURALITY OF RING SECTORS MADE OF CERAMIC MATRIX COMPOSITE MATERIAL

(71) Applicants: HERAKLES, Le Haillan (FR); SAFRAN AIRCRAFT ENGINES, Paris (FR)

(72) Inventors: Claire Groleau, Montrouge (FR); Gilles Lepretre, Saint Aubin de Medoc (FR); Etienne Voland, Merignac (FR); Thierry Tesson, Bordeaux (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 81 days.

(21) Appl. No.: 15/558,829

(22) PCT Filed: Mar. 16, 2016

(86) PCT No.: PCT/FR2016/050580
§ 371 (c)(1),
(2) Date: Sep. 15, 2017

(87) PCT Pub. No.: WO2016/146942
PCT Pub. Date: Sep. 22, 2016

(65) Prior Publication Data

US 2018/0080343 A1 Mar. 22, 2018

(30) Foreign Application Priority Data

Mar. 16, 2015 (FR) ..... 15 52147

(51) Int. Cl.
*F01D 11/08* (2006.01)
*F01D 25/24* (2006.01)
(Continued)

(52) U.S. Cl.
CPC ..... *F01D 25/246* (2013.01); *F01D 9/04* (2013.01); *F01D 25/005* (2013.01);
(Continued)

(58) Field of Classification Search
CPC ..... F01D 25/246; F01D 25/005; F01D 9/04; F01D 11/00; F01D 11/08; F05D 2240/11;
(Continued)

(56) References Cited

U.S. PATENT DOCUMENTS 6,435,824 B1 8/2002 Schell et al.
8,480,353 B2 * 7/2013 Koyabu ..... F01D 9/04 415/116
(Continued)

FOREIGN PATENT DOCUMENTS

GB 2 344 140 A 5/2000
WO WO 2006/136755 A2 12/2006

OTHER PUBLICATIONS

International Search Report as issued in International Patent Application No. PCT/FR2016/050580, dated May 25, 2016.
(Continued)

*Primary Examiner* — Ninh H. Nguyen
*Assistant Examiner* — Maxime M Adjagbe
(74) *Attorney, Agent, or Firm* — Pillsbury Winthrop Shaw Pittman LLP

(57) ABSTRACT

A turbine ring assembly includes a plurality of ring sectors made of ceramic matrix composite material, together with a ring support structure, each ring sector having a portion forming an annular base with an inner face defining the inner face of the turbine ring and an outer face from which there project at least two tab-forming portions, the ring support structure having at least two attachment tabs extending
(Continued)

radially, the tabs of each ring sector gripping the attachment tabs of the ring support structure at least at the radially-inner ends of the attachment tabs.

10 Claims, 3 Drawing Sheets

(51) Int. Cl.
*F01D 9/04* (2006.01)
*F01D 25/00* (2006.01)

(52) U.S. Cl.
CPC ..... *F05D 2220/32* (2013.01); *F05D 2250/75* (2013.01); *F05D 2300/6033* (2013.01)

(58) Field of Classification Search
CPC ..... F05D 2260/30; F05D 2220/32; F05D 2230/642
See application file for complete search history.

(56) References Cited

U.S. PATENT DOCUMENTS

| | | | | |
|---|---|---|---|---|
| 2004/0047726 | A1 | 3/2004 | Morrison | |
| 2009/0081033 | A1 | 3/2009 | Schiavo et al. | |
| 2012/0027572 | A1 | 2/2012 | Denece et al. | |
| 2014/0271145 | A1* | 9/2014 | Thomas | F01D 11/08 415/173.1 |
| 2017/0211479 | A1* | 7/2017 | Little | F01D 9/023 |

OTHER PUBLICATIONS

First Office Action as issued in Chinese Patent Application No. 201680016325.6, dated Feb. 12, 2019.

* cited by examiner

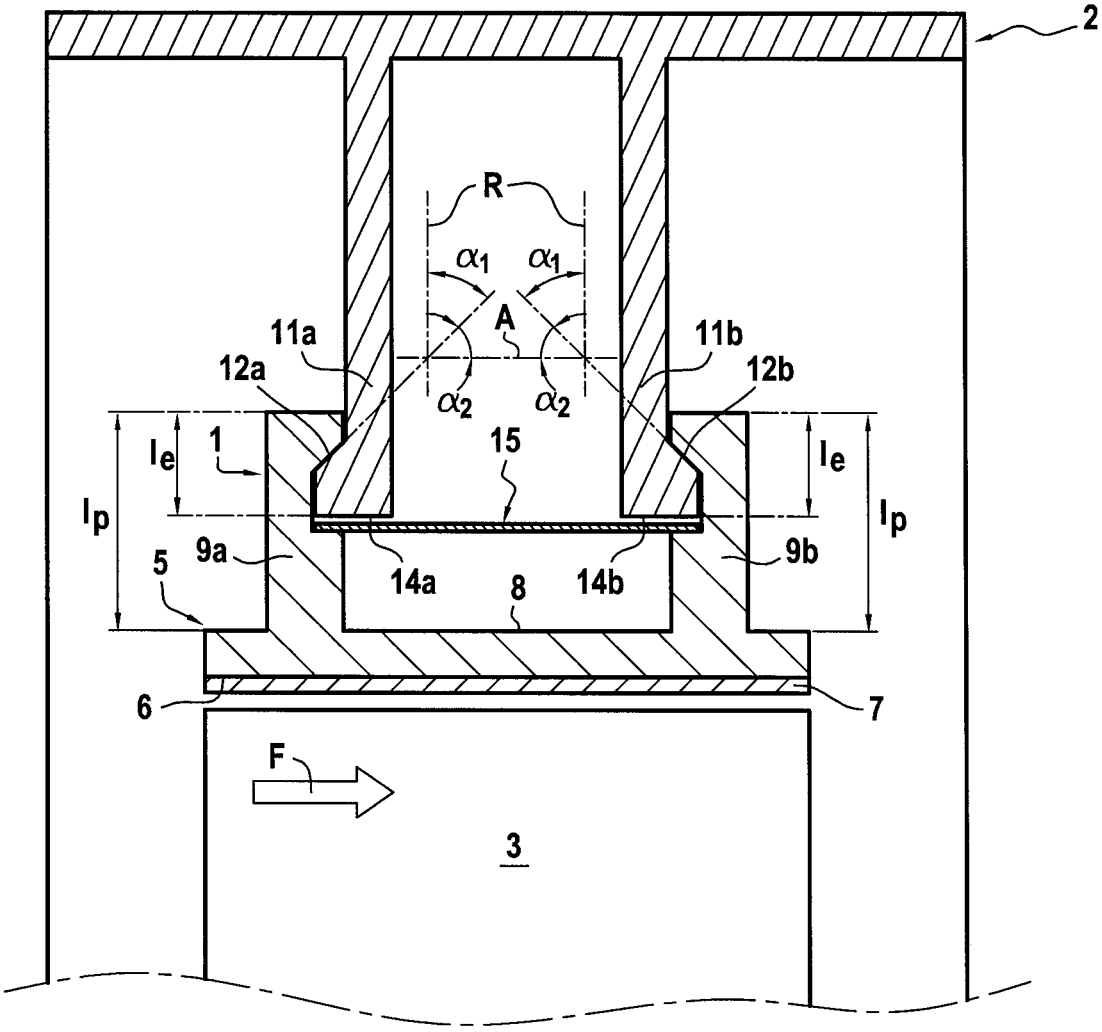
FIG.1
FIG.2
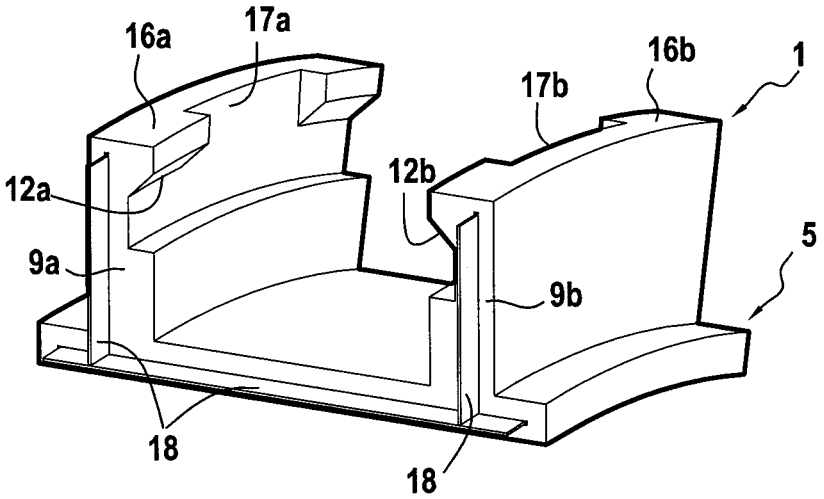

TURBINE RING ASSEMBLY COMPRISING A PLURALITY OF RING SECTORS MADE OF CERAMIC MATRIX COMPOSITE MATERIAL

CROSS REFERENCE TO RELATED APPLICATIONS

This application is the U.S. National Stage of PCT/FR2016/050580 filed Mar. 16, 2016, which in turn claims priority to French Application No. 1552147, filed Mar. 16, 2015. The contents of both applications are incorporated herein by reference in their entirety.

BACKGROUND OF THE INVENTION

The invention relates to a turbine ring assembly comprising a plurality of ring sectors made of ceramic matrix composite material together with a ring support structure.

For turbine ring assemblies that are made entirely out of metal, it is necessary to cool all of the elements of the assembly and in particular the turbine ring, which is subjected to the highest temperature streams. This cooling has a significant impact on the performance of the engine, since the cooling stream that is used is taken from the main stream of the engine. In addition, using metal for the turbine ring limits potential for increasing temperature within the turbine, even though that would serve to improve the performance of aeroengines.

In an attempt to solve those problems, proposals have been made for turbine ring sectors to be made out of ceramic matrix composite (CMC) material in order to avoid using a metal material.

CMC materials present good mechanical properties that make them suitable for constituting structural elements, and advantageously they conserve those properties at high temperatures. Using CMC materials advantageously makes it possible to reduce the cooling stream required in operation and thus to increase the performance of turbine engines. Furthermore, using CMC materials advantageously serves to reduce the weight of turbine engines and to reduce the effect of high temperature expansion encountered with metal parts.

Nevertheless, the existing solutions that have already been proposed can involve assembling a CMC ring sector with metal attachment portions of a ring support structure, with the attachment portions being subjected to the hot stream. Consequently, those assembly solutions can continue to require the use of a cooling stream, at least for cooling said attachment portions that are made of metal. In addition, those metal attachment portions are subjected to expansion at high temperature, which can lead to the CMC ring sectors being subjected to mechanical stress and to them being weakened.

Turbine ring assemblies are also disclosed in Documents US 2014/0271145, US 2004/0047726, U.S. Pat. No. 6,435,824, and GB 2 344 140.

There therefore exists a need to improve existing turbine ring assemblies that make use of CMC material in order to further reduce the quantity of cooling gas that is needed.

There also exists a need to improve existing turbine ring assemblies that make use of CMC material in order to reduce the magnitude of the mechanical stresses to which the CMC ring sectors are subjected in operation.

OBJECT AND SUMMARY OF THE INVENTION

To this end, and in a first aspect, the invention proposes a turbine ring assembly comprising a plurality of ring sectors made of ceramic matrix composite material, together with a ring support structure, each ring sector having a portion forming an annular base with an inner face defining the inner face of the turbine ring and an outer face from which there project at least two tab-forming portions, the ring support structure having at least two attachment tabs extending radially, the tabs of each ring sector gripping the attachment tabs of the ring support structure at least at the radially-inner ends of said attachment tabs.

The radial direction corresponds to the direction along a radius of the turbine ring (a straight line connecting the center of the turbine ring to its periphery). The radially-inner end of an attachment tab corresponds to the end of said attachment tab that is situated beside the gas stream flow passage.

In the invention, the attachment tabs of the ring support structure are received at least in part between the tabs of the ring sectors. These attachment tabs are thus protected from the hot stream by the CMC ring sector that grips them axially and that presents low thermal conductivity, thereby constituting a thermal barrier for said attachment tabs. The CMC ring sector thus makes it possible to obtain thermal decoupling between the inner face of the turbine ring and the attachment tabs that it clamps. The configuration of the invention thus makes it possible to reduce the quantity of gas that is needed for cooling the attachment tabs of the ring support structure, and consequently leads to an increase in the performance of the engine.

Preferably, the ring sector tabs present, in meridian section, sloping portions facing the attachment tabs of the ring support structure, which sloping portions form respective non-zero angles relative to the radial direction and to the axial direction.

The axial direction corresponds to the direction along the axis of revolution of the turbine ring and to the flow direction of the gas stream in the passage.

The use of such sloping portions serves advantageously to cause the ring sector tabs to slide over the attachment tabs of the ring support structure in the event of differential expansion, and consequently to compensate for the differences in expansion between the attachment tabs and the tabs of the ring sector, and also to reduce the mechanical stresses to which the ring sectors are subjected. The presence of sloping portions thus makes it possible to obtain sliding of the ring sectors in the event of radial and/or axial expansion of the attachment tabs, thereby making it possible to avoid any radial or axial jamming of the ring sectors and thus to avoid them being subjected to stresses that are too great. The presence of sloping portions is particularly advantageous when the attachment tabs are received between the tabs of ring sectors, such that the attachment tabs consequently have relatively restricted space for expansion, which could lead to significant mechanical stress being applied against the tabs of the ring sectors if they were not provided with such sloping portions.

In an embodiment, the tabs of the ring sectors may grip the attachment tabs over a length that is less than the length of the tabs of the ring sectors.

In a variant, the tabs of the ring sectors may grip the attachment tabs over a length that is equal to the length of the tabs of the ring sectors.

This embodiment advantageously makes it possible to increase the area of the bearing surfaces between the tabs of the ring sectors and the attachment tabs, and to reduce the presence of local forces in the bearing surfaces.

In an embodiment, the sloping portions may form an angle lying in the range 30° to 60° with the radial direction.

Preferably, the tabs of the ring sectors may present recesses at their radially-outer ends, which recesses extend in a tangential direction.

The radially-outer end of a tab of a ring sector corresponds to the end of said tab that is situated remote from the gas stream flow passage. The tangential direction corresponds to the circumferential direction of the turbine ring.

The presence of such recesses serves advantageously to reduce the mechanical stresses to which the ring sector is subjected while in operation.

Preferably, an elastic damper element may be present between the radially-inner ends of the attachment tabs of the ring support structure and the annular base of the ring sector having the tabs gripping said attachment tabs.

The presence of such a damper element serves advantageously to damp the radial movements of the ring sectors and thus to contribute to holding the ring sectors on the attachment tabs during operation.

In an embodiment, the damper elements may include openings. The presence of one or more openings may advantageously enable the ring sectors to be cooled.

In an embodiment, the ring sectors present a section that is substantially π-shaped.

The present invention also provides a turbine engine including a turbine ring assembly as defined above.

In an embodiment, the turbine ring assembly may form part of the turbine nozzle in the turbine engine.

The turbine ring assembly may form a portion of an aviation gas turbine engine, or in a variant it may form a portion of an industrial gas turbine.

BRIEF DESCRIPTION OF THE DRAWINGS

Other characteristics and advantages of the invention appear from the following description of particular embodiments of the invention given as non-limiting examples and with reference to the accompanying drawings, in which:

FIG. 1 is a meridian section view showing an embodiment of a turbine ring assembly of the invention;

FIG. 2 shows in isolation a ring sector used in the FIG. 1 turbine ring assembly;

DETAILED DESCRIPTION OF EMBODIMENTS

Figure 3:
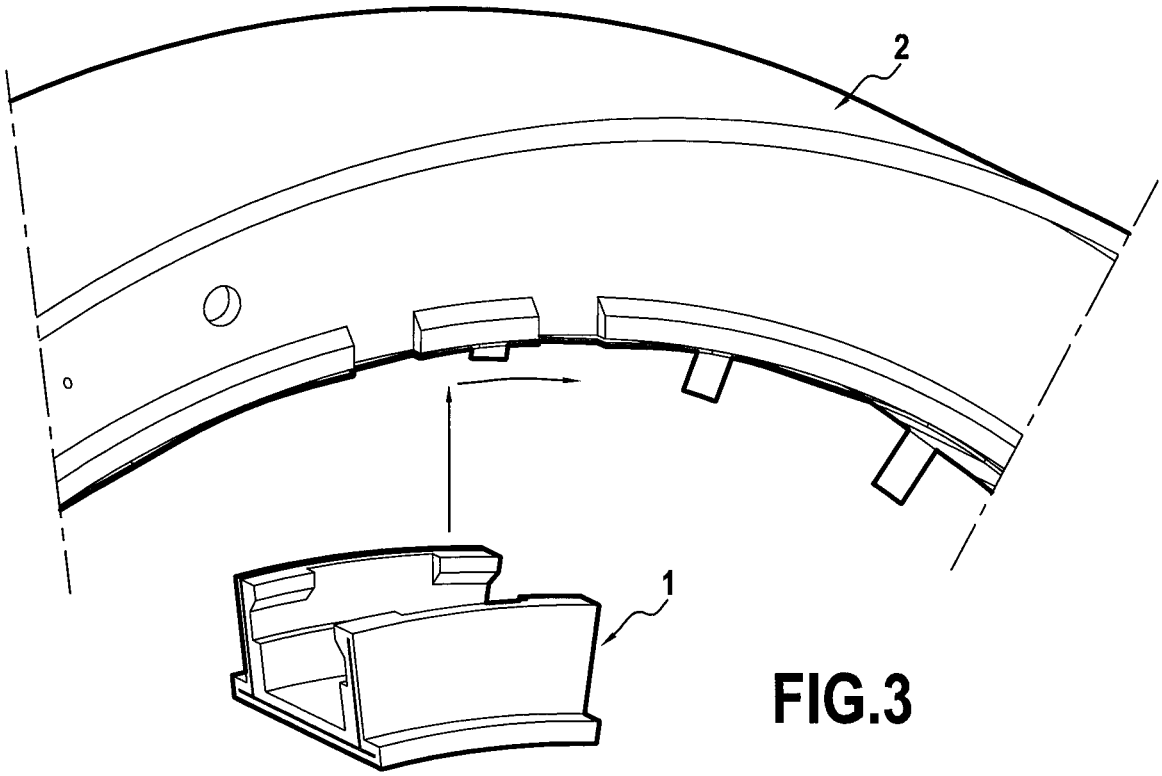
FIG. 3 shows one of the ring sectors being mounted on the ring support structure in order to obtain the FIG. 1 turbine ring assembly.

FIG. 1 shows a turbine ring sector 1 and a casing 2 made of metal material and constituting a ring support structure. The set of ring sectors 1 is assembled on the casing 2 so as to form a turbine ring that surrounds a set of rotary blades 3. The arrow F shows the flow direction of the gas stream through the turbine. The ring sectors 1 are made as single pieces out of CMC. Using a CMC material for making the ring sectors 1 is advantageous in order to reduce requirements for ventilating the ring. The ring sectors 1 have a section that is substantially π-shaped, with an annular base 5 having its inner face 6 relative to the radial direction R coated in a layer 7 of abradable material so as to define the gas stream flow path through the turbine. The annular base 5 also presents an outer face 8 relative to the radial direction R from which there project tabs 9*a* and 9*b*.

Each above-described ring sector 1 is made of CMC by forming a fiber preform having a shape that is close to that of the ring sector and by densifying the ring sector with a ceramic matrix.

In order to make the fiber preform, it is possible to use yarns made of ceramic fibers, e.g. yarns made of SiC fibers such as those sold by the Japanese supplier Nippon Carbon under the name "Nicalon", or else yarns made of carbon fibers.

The fiber preform is advantageously made by three-dimensional weaving, or by multilayer weaving with zones of non-interlinking being provided so as to enable the preform portions that correspond to the tabs 9*a* and 9*b* to be moved away from the preform portion that corresponds to the base 5.

The weaving may be of the interlock type. Other three-dimensional or multilayer weaves can be used, e.g. such as multi-plain or multi-satin weaves. Reference may be made to Document WO 2006/136755.

After weaving, the blank may be shaped so as to obtain a ring sector preform that is then consolidated and densified with a ceramic matrix, where densification may be performed in particular by chemical vapor infiltration (CVI), as is well known. A detailed example of fabricating ring sectors out of CMC is described in particular in Document US 2012/0027572.

The casing 2 has attachment tabs 11*a* and 11*b* that extend radially towards the gas stream flow path, the tabs 9*a* and 9*b* of the ring sectors 1 axially gripping the attachment tabs 11*a* and 11*b* of the casing 2 in leaktight manner. The tabs 9*a* and 9*b* of the ring sectors apply pressure along the axial direction A against the attachment tabs 11*a* and 11*b* of the casing 2. The tabs 9*a* and 9*b* of the ring sectors 1 are not present between the attachment elements of the ring support structure 2. On the contrary, it is the attachment tabs 11*a* and 11*b* of the ring support structure 2 that are present between the tabs 9*a* and 9*b* of the ring sectors 1. The ring support structure 2 does not grip the tabs 9*a* and 9*b* of the ring sectors 1. The fact that the tabs 9*a* and 9*b* of the ring sectors 1 grip the attachment tabs 11*a* and 11*b* of the ring support structure 2 makes it possible to ensure that the ring sectors 1 are fastened to the support structure 2. This gripping is sufficient to ensure that the ring sectors 1 are fastened to the ring support structure 2. The turbine ring assembly does not have elements of the ring support structure 2 that come to grip the tabs 9*a* and 9*b* of the sectors 1. The tabs 9*a* and 9*b* of the ring sectors 1 grip the attachment tabs of the casing 2 both when cold (i.e. at a temperature of 20° C.) and when hot (i.e. in operation).

The attachment tabs 11*a* and 11*b* of the casing 2 are received in part between the tabs 9*a* and 9*b* of the ring sectors 1, as shown (i.e. only a portion of the length of each attachment tab 11*a* or 11*b* is received between the tabs 9*a* and 9*b*). In particular, the radially-inner ends 14*a* and 14*b* of the attachment tabs 11*a* and 11*b* are gripped between the tabs 9*a* and 9*b*. The fact that the tabs 9*a* and 9*b* grip the attachment tabs 11*a* and 11*b* axially advantageously serves to protect the attachment tabs 11*a* and 11*b* from the gas stream flowing in the passage, since the ring sector 1 withstands high temperatures and forms a thermal barrier. The presence of the differential expansion phenomenon can also advantageously make it possible to maintain the leaktightness of the connection between the ring sectors 1 and the attachment tabs 11*a* and 11*b* of the casing 2. Specifically, axial expansion of the attachment tabs 11*a* and 11*b* enables a small amount of pressure to be exerted on the tabs 9*a* and 9*b* of the ring sectors 1, thereby serving to maintain the leaktightness of the connection.

The attachment tabs 11*a* and 11*b* are gripped axially between sloping portions 12*a* and 12*b* defined by the tabs 9*a* and 9*b* of the ring sector 1. As shown, the sloping portions 12*a* and 12*b* are situated facing the attachment tabs 11*a* and 11*b* and bear against said attachment tabs 11*a* and 11*b* in order to grip them. The sloping portions 12*a* and 12*b* are in contact with the attachment tabs 11*a* and 11*b*. As shown, each sloping portion 12*a* and 12*b* extends in a straight line forming a non-zero angle $\alpha_1$ relative to the radial direction R, and a non-zero angle $\alpha_2$ relative to the axial direction A. The sloping portions 12*a* and 12*b* can thus be rectilinear in shape when observed in meridian section. As mentioned above, using these sloping portions 12*a* and 12*b* advantageously makes it possible to compensate for expansion differences between the attachment tabs 11*a* and 11*b* and the tabs 9*a* and 9*b* of the ring sectors 1, and also to reduce the mechanical stresses to which the ring sectors 1 are subjected. In the example shown, the ring sector 1 is thus connected to the attachment tabs 11*a* and 11*b* of the casing 2 via an attachment referred to as a hammer attachment. By way of example, the angle $\alpha_1$ may lie in the range 30° to 60°. In meridian section, the attachment tabs 11*a* and 11*b* also present sloping portions that form a non-zero angle with the radial and axial directions, which angle may for example lie in the range 30° to 60°. The sloping portions of the attachment tabs 11*a* and 11*b* are situated facing the sloping portions 12*a* and 12*b* of the tabs 9*a* and 9*b* of the ring sectors 1. The sloping portions 12*a* and 12*b* of the tabs 9*a* and 9*b* bear against the attachment tabs 11*a* and 11*b* via the sloping portions of said attachment tabs 11*a* and 11*b*. In the example shown, the sloping portions of the attachment tabs 11*a* and 11*b* have the same shape as the sloping portions 12*a* and 12*b* of the tabs 9*a* and 9*b* of the sectors 1.

In the example shown in FIG. 1, each of the tabs 9*a* or 9*b* presents a single sloping portion 12*a* or 12*b* forming a non-zero angle relative to the radial direction R and relative to the axial direction A. It would not go beyond the ambit of the present invention for each of the tabs of the ring sectors to have a plurality of sloping portions, as described in detail below. As shown in FIG. 1, the tabs 9*a* and 9*b* of the ring sectors grip the attachment tabs 11*a* and 11*b* over a length $l_e$ that is shorter than the length $l_p$ of the tabs 9*a* and 9*b* of the ring sector 1. As shown, the lengths $l_e$ and $l_p$ are measured perpendicularly to the outer face 8 of the annular base 5 of the ring sector 1. By way of example, the length $l_e$ may be less than or equal to 0.75 times the length $l_p$.

FIG. 1 shows an embodiment in which only a fraction of the length of each attachment tab 11*a* and 11*b* is received between the tabs 9*a* and 9*b*. In a variant that is not shown, the tabs of the ring sector are of length that is sufficient to be capable of gripping substantially the entire length of the attachment tabs.

In the example shown in FIG. 1, a resilient damper element 15 is present between the radially-inner ends 14*a* and 14*b* of the attachment tabs 11*a* and 11*b* and the annular base 5 of the ring sector 1 having its tabs 9*a* and 9*b* gripping said attachment tabs 11*a* and 11*b*. By way of example, the resilient damper element 15 may be in the form of a plate, e.g. made of a metal material. The damper element 15 may include one or more openings. The presence of these openings is advantageous in order to enable the ring sector 1 to be cooled.

FIG. 2 shows a ring sector 1 in isolation as used in the FIG. 1 turbine ring assembly. As shown, the tabs 9*a* and 9*b* of the ring sector 1 present recesses 17*a* and 17*b* at their radially-outer ends 16*a* and 16*b*, the recesses extending tangentially when the ring sector 1 is fastened to the ring support structure. As mentioned above, the presence of recesses 17*a* and 17*b* serves advantageously to reduce the mechanical stresses to which the ring sector 1 is subjected in operation. Furthermore, the ring sector 1 may include one or more sealing strips 18. Once all of the ring sectors 1 have been assembled on the ring support, these sealing strips 18 serve to reduce or even eliminate leaks of air between the ring sectors 1.

Figure 4:
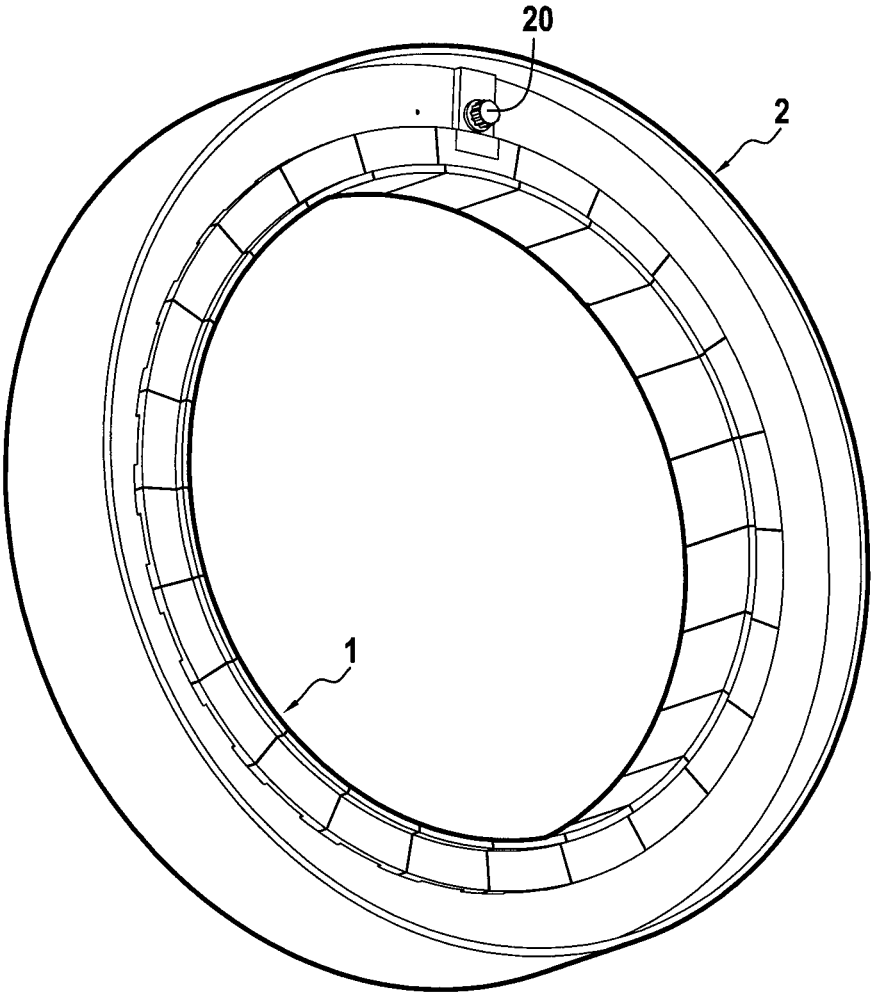
FIG. 4 is an overall view of the FIG. 1 turbine ring assembly once all of the ring sectors have been assembled.

FIG. 3 shows a ring sector 1 being assembled with the casing 2. The ring sector 1 for assembling is presented facing the notch in the casing 2. In an embodiment, the ring sector 1 for assembling may be provided with a damper element 15, as shown in FIG. 1. The ring sector 1 is inserted in translation and is then shifted angularly as represented by arrows in FIG. 3. FIG. 4 is a view of the FIG. 1 turbine ring assembly once all of the ring sectors have been assembled. As shown, a plurality of CMC ring sectors 1 are assembled on the ring support structure 2. The turbine ring assembly also includes a closure key 20 that is present in register with one of the ring sectors and that serves to provide cohesion for the assembly of the ring sectors with one another. The closure key 20 is present in register with the last ring sector to be assembled.

Figure 5:
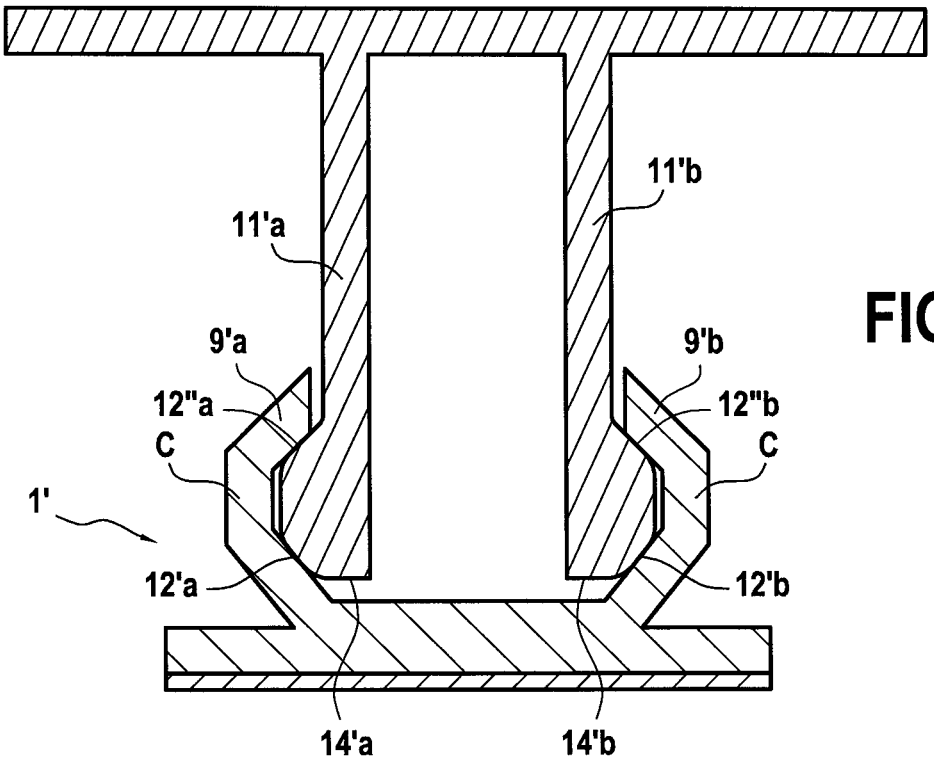
FIG. 5 is a meridian section view showing a variant embodiment of a turbine ring assembly of the invention.

FIG. 5 shows a variant embodiment in which the tabs 9'*a* and 9'*b* of the ring sectors 1' grip the attachment tabs 11'*a* and 11'*b* over a length that is substantially equal to the length of the tabs 9'*a* and 9'*b*. In the example of FIG. 5, each of the tabs 9'*a* and or 9'*b* presents a first sloping portion 12'*a* or 12'*b* forming non-zero angles relative to the radial direction and to the axial direction, together with a second sloping portion 12"*a* or 12"*b* forming non-zero angles relative to the radial direction and to the axial direction. The first and second sloping portions are present on either side of a bend C formed by the tabs 9'*a* and 9'*b* of the ring sector 1'. As shown, the bend C may be situated substantially halfway along the tabs 9'*a* and 9'*b*.

The term "lying in the range . . . to . . . " should be understood as including the end values.

The invention claimed is:

1. A turbine ring assembly comprising a plurality of ring sectors made of ceramic matrix composite material, together with a ring support structure, each ring sector having a portion forming an annular base with an inner face defining the inner face of the turbine ring and an outer face from which there project at least two tab-forming portions, the ring support structure having at least two attachment tabs extending radially, the tab-forming portions of each ring sector axially gripping the attachment tabs of the ring support structure at least at radially-inner ends of said attachment tabs, at least tab portions of the attachment tabs of the ring support structure being located between the tab-forming portions of each ring sector, and the tab-forming portions of each ring sector not being present between corresponding attachment tabs of the ring support structure, the tab-forming portions of the ring sectors presenting, in meridional section, sloping portions bearing against the attachment tabs of the ring support structure, the sloping portions forming respective non-zero angles relative to a radial direction and to an axial direction.

2. The turbine ring assembly according to claim 1, wherein the tab-forming portions of the ring sectors grip the attachment tabs over a length that is less than the length of the tab-forming portions of the ring sectors.

3. The turbine ring assembly according to claim 1, wherein the tab-forming portions of the ring sectors grip the attachment tabs over a length that is substantially equal to the length of the tabs of the ring sectors.

4. The turbine ring assembly according to claim 1, wherein the sloping portions form an angle lying in the range 30° to 60° with the radial direction.

5. The turbine ring assembly according to claim 1, wherein the tabs of the ring sectors present recesses at their radially-outer ends, which recesses extend in a circumferential direction of the turbine ring.

6. The turbine ring assembly according to claim 1, wherein an elastic damper element is present between the radially-inner ends of the attachment tabs of the ring support structure and the annular base of each of the ring sectors having respective tabs gripping said attachment tabs.

7. The turbine ring assembly according to claim 6, wherein the elastic damper elements include openings.

8. The turbine ring assembly according to claim 1, wherein the ring sectors present a section that is substantially π-shaped.

9. A turbine engine including a turbine ring assembly according to claim 1.

10. A turbine ring assembly comprising a plurality of ring sectors made of ceramic matrix composite material, together with a ring support structure, each ring sector having a portion forming an annular base with an inner face defining the inner face of the turbine ring and an outer face from which there project at least two tab-forming portions, the ring support structure having at least two attachment tabs extending radially, the tab-forming portions of each ring sector axially gripping the attachment tabs of the ring support structure at least at radially-inner ends of said attachment tabs, the tab-forming portions of the ring sectors presenting, in meridional section, sloping portions bearing against the attachment tabs of the ring support structure, the sloping portions forming respective non-zero angles relative to a radial direction and to an axial direction, and wherein the tab-forming portions of the ring sectors further present, in meridional section, radial portions bearing against the attachment tabs of the ring support structure and distinct from the sloping portions.

* * * * *